United States Patent [19]

Terokomos

[11] Patent Number: 4,978,448

[45] Date of Patent: Dec. 18, 1990

[54] SYSTEM FOR RECOVERY OF FLOATING MATERIAL FROM THE SURFACE OF A BODY OF WATER

[76] Inventor: Nikiforos Terokomos, P.O. Box 317, Parksville, N.Y. 12768

[21] Appl. No.: 419,539

[22] Filed: Oct. 10, 1989

[51] Int. Cl.[5] ..... E02B 15/04

[52] U.S. Cl. ..... 210/242.3; 210/242.4; 210/923; 210/924

[58] Field of Search ..... 210/242.3, 242.4, 776, 210/923, 924

[56] References Cited

U.S. PATENT DOCUMENTS

| | | | |
|---|---|---|---|
| Re. 30,729 | 9/1981 | Farrell et al. | 210/242.3 |
| 3,426,962 | 2/1969 | Kilpert et al. | 210/923 |
| 3,576,257 | 4/1971 | Yates | 210/242.3 |
| 3,700,107 | 10/1972 | Flaviani | 210/242.3 |
| 3,700,108 | 10/1972 | Richards | 210/242.3 |
| 3,731,813 | 5/1973 | Tipton | 210/242.3 |
| 3,785,496 | 1/1974 | Smith, Jr. | 210/242.3 |
| 3,822,789 | 7/1974 | Crisafulli | 210/242.3 |
| 3,947,360 | 3/1976 | Fast | 210/242.3 |
| 3,968,041 | 7/1976 | De Voss | 210/242.3 |
| 4,013,561 | 3/1977 | Murphy | 210/242.3 |
| 4,108,773 | 8/1978 | Macaluso | 210/122 |
| 4,261,827 | 4/1981 | Bronnec | 210/242.3 |
| 4,370,229 | 1/1983 | Grihangne | 210/923 |

FOREIGN PATENT DOCUMENTS

| | | |
|---|---|---|
| 931881 | 8/1973 | Canada . |
| 2378905 | 9/1978 | France . |
| 52-35369 | 3/1977 | Japan . |
| 52-51165 | 4/1977 | Japan . |
| 716567 | 2/1980 | U.S.S.R. . |

*Primary Examiner*—W. Gary Jones
*Assistant Examiner*—Christopher Upton
*Attorney, Agent, or Firm*—Dorr, Carson, Sloan & Peterson

[57] ABSTRACT

The present invention provides a system for recovering floating material, such as pollutants or debris, from the surfaces of bodies of water. This system is designed to be modular to be quickly transportable to any desired area in the world. The system uses an elongated scoop having a spiral shaped cross-section mounted on a floating vessel to pick up the floating material in a substantially laminar flow. The material is separated from the surface by a rotating frame having a mechanism on its periphery to separate the material. The mechanism can be of several embodiments including compressible absorbent pads, rigid or flexible paddles, permeable layers and eccentric frames. The separated material is removed from the separating mechanism and deposited into retaining troughs. The collected material is then pumped to inflatable collecting tanks which are towed behind the catamaran. The system is designed to be adaptable to a wide range of conditions and sites.

67 Claims, 5 Drawing Sheets

16
14
22
21
18
34
30
10
12
32
36
24
26
25
28
25
38
20
21

SYSTEM FOR RECOVERY OF FLOATING MATERIAL FROM THE SURFACE OF A BODY OF WATER

BACKGROUND OF THE INVENTION

1. Field of the Invention

This invention relates to apparatus for removing debris, pollutants and other floating material from the surface of bodies of water.

2. Statement of the Problem

Environmental awareness is becoming increasingly more prevalent in response to preservation of the global ecology. The advent of offshore drilling platforms and the use of supertankers to transport crude oil and the like has greatly increased the likelihood and magnitude of catastrophic damage to the oceans, lakes, and rivers by contamination due to spillage of pollutants on these bodies of waters. The damage and destruction from these pollutants can wreak havoc to the ecology that can potentially take decades to recover.

Current methods of cleaning polluted waters have been unsatisfactory, particularly when the conditions have been less than ideal. Speed in cleaning spills is critical due to the rapid spreading of the floating surface material by the currents and wind. Delays may occur in cleaning isolated sites due to problems in transporting the equipment to the site. The turbulence of the oceans or other bodies of water often prevents the equipment from being used.

The apparatus currently used are simple mechanisms such as handheld devices or throwing rags or straw on the surface to absorb the material which are ineffective in cleaning large areas or else complex devices which are expensive to manufacture and to maintain. The complex devices normally are not effective in completely removing pollutants from the surfaces, particularly when there is a wide range of depth of the pollutants, turbulence of the surfaces and difficulties in the site conditions.

Other methods utilizing chemicals or burning of the floating material are dangerous to the environment and are simply not feasible for large areas that may need to be cleaned.

There presently exists a need for a system to quickly recover floating material such as pollutants or debris from the surfaces of bodies of water without regard to the demands of the particular site conditions.

3. Solution to the Problem

The present invention solves this problem and others by providing a modular self-contained system which can be easily transportable. This system can be operated in a wide variety of sites and under a wide range of conditions. The system of the current invention is designed to be relatively simple and inexpensive but is effective in recovering floating materials from the surfaces of bodies of water almost regardless of the depth of the materials floating on the surface or the turbulence of the surface or the condition of the site.

SUMMARY OF THE INVENTION

The present invention provides a system for recovering floating material, such as pollutants or debris, from the surfaces of bodies of water. This system is designed to be modular to be quickly transportable to any desired area in the world. The system uses an elongated scoop having a spiral shaped cross-section mounted on a floating vessel such as a catamaran to pick up the floating material in a substantially laminar flow. The material is separated from the surface by a rotating frame having a mechanism on its periphery to separate the material. The mechanism can be of several embodiments including compressible absorbent pads, rigid or flexible paddles, permeable layers and eccentric cylinders. The separated material is removed from the separating mechanism and deposited into retaining troughs. The collected material is then pumped to inflatable collecting tanks which are towed behind the floating vessel. The system is designed to be adaptable to a wide range of conditions and sites.

DETAILED DESCRIPTION OF THE PREFERRED EMBODIMENT

The present invention provides a system for recovering floating material such as debris, crude and other oil spillage, pollutants and the like from the surfaces of bodies of water. This system is designed to operate to efficiently recover such material almost regardless of the turbulence of the surface, the depth of the material floating on the surface to be recovered or the location and condition of the site to be cleaned. A preferred embodiment is illustrated in FIG. 1 showing a system 14 recovering floating material 12 from the surface 10 of a body of water.

Figure 1:
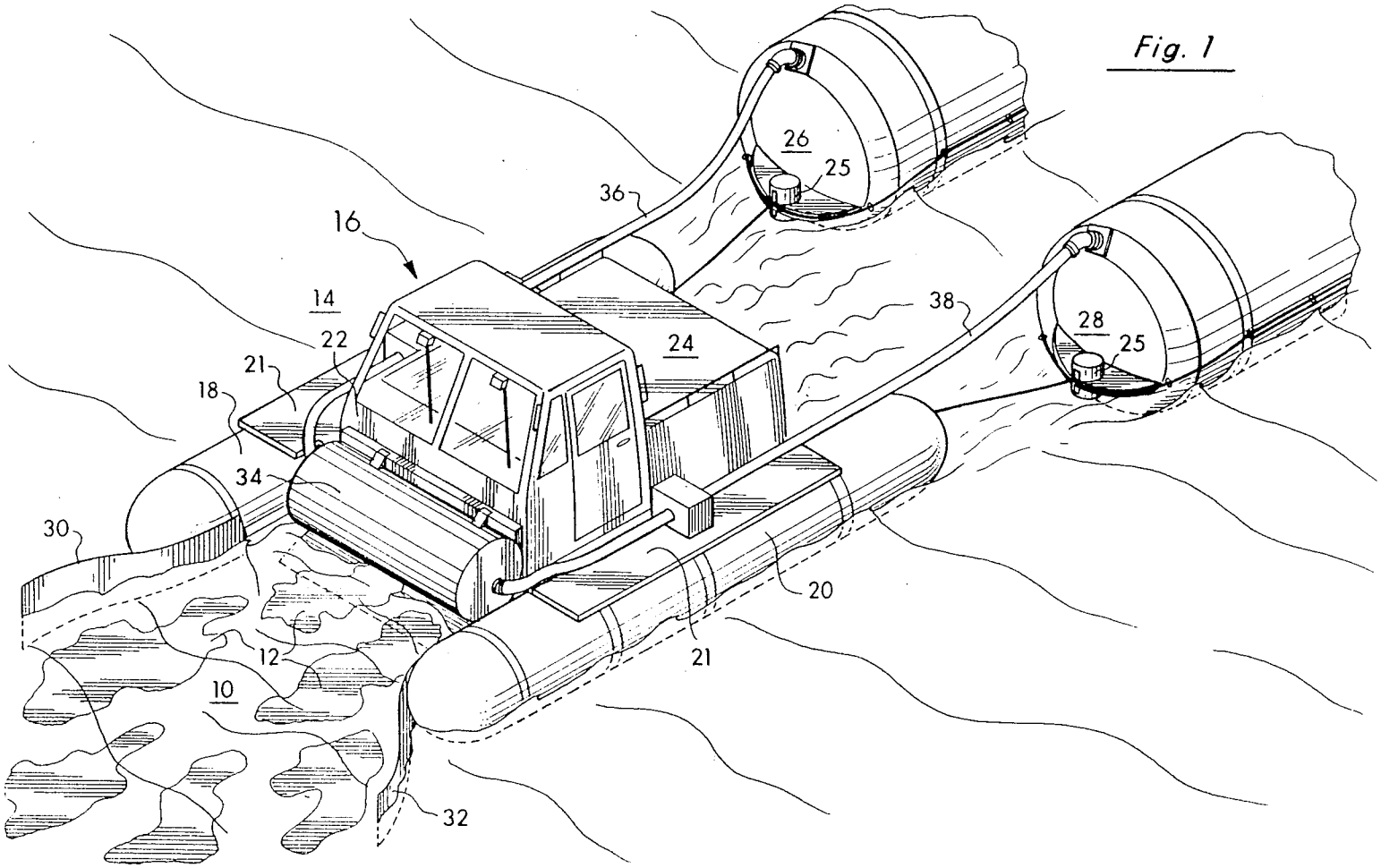
FIG. 1 is a perspective view of the system of the current invention in operation.

As shown in FIG. 1, this system is designed to be modular so the entire system can be quickly transported to the desired location. The system 14 includes a catamaran 16 having inflatable pontoons 18 and 20 with a detachable control cabin 22 and a detachable engine structure 24 mounted on a platform 21. The system 14 is not meant to be limited to a catamaran but could easily utilize other floating structures, for example, a barge or a self contained floating vessel. Towed behind the vessel 16 and having self-winding cable mechanisms 25 are two inflatable tanks 26 and 28 to retain the collected material 12 once it is separated from the surface 10 of the water. The system 14 further includes booms 30 and 32 to divert the material into a scoop 34 discussed fully below, which separates the material 12 from the surface 10. The material 12 is then pumped through hoses 36 and 38 into the collecting tanks 26 and 28.

The modular system 14 is collapsible to pallet sizes to be quickly and easily transported to a site that is to be cleaned. At the site it can be rapidly assembled and launched. The use of the inflatable collection tanks 26 and 28 of a number and size necessary provides immediate storage of the collected material without the wait for additional tanker vessels. The recovery process can begin immediately upon the assembly and launch of the present system.

Figure 2:
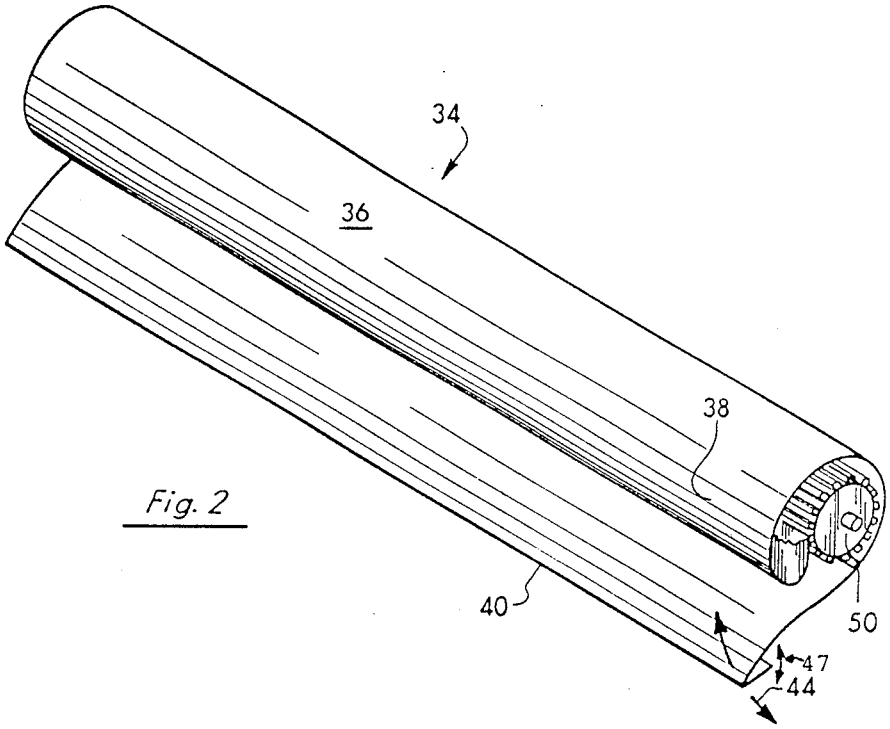
FIG. 2 is a perspective view of the scoop of the current invention.
Figure 3:
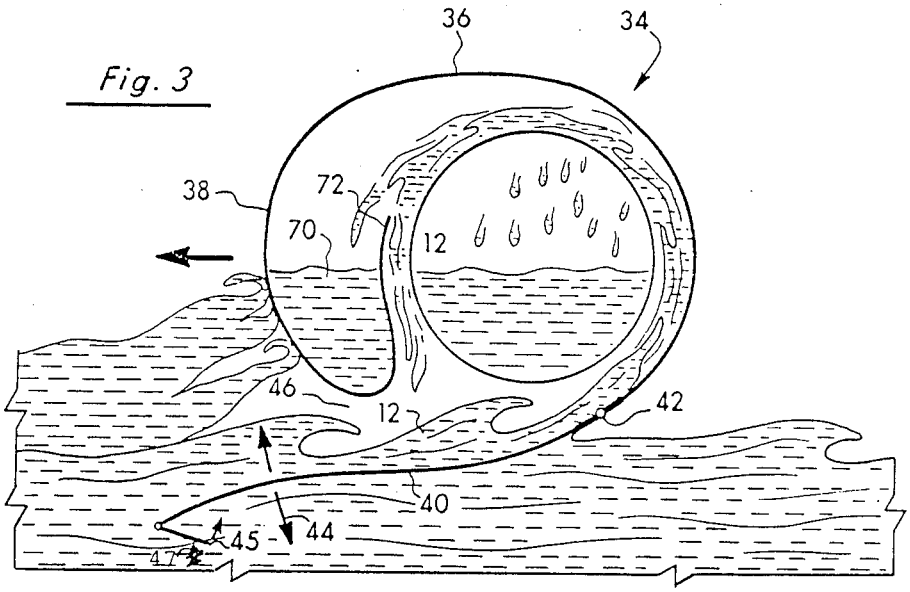
FIG. 3 is a cross-section view of the scoop of FIG. 2.

Illustrated in FIGS. 2 and 3 is the scoop 34 of the preferred embodiment. The scoop 34 includes an elongated housing 36 having a spiral-shaped cross-section. The housing 36 includes a front leading surface 38 and an articulated lower tail portion 40 pivotally mounted to the housing 36 at pivot point 42. The lower tail portion 40 extends beyond the front leading surface 38 to provide a scooping action under the floating material. The lower tail portion 40 is designed to be pivoted as indicated by arrow 44 by hydraulic control means not shown.

Pivotally mounted to the tip of the leading edge of the lower tail portion 40 is an articulated hydro-wing 45. The hydro-wing 45 extends downwardly and rearwardly from the tip of the lower tail portion 40. The hydro-wing 45 provides a hydrodynamic shape to the lower tail portion 40 to prevent the tail portion from being lifted or pushed by the action of the water acting against it. The hydro-wing is pivoted relative to the lower tail portion in the direction of arrow 47 by hydraulic means not shown to a position to hold the lower tail portion in equilibrium relative to the action of the water depending on the adjustment of the lower tail portion 40.

The front leading surface 38 and the lower tail portion 40 define an opening 46 for the floating material 12 to enter the scoop 34. In the preferred embodiment illustrated in FIG. 3, the front leading surface 38 extends substantially perpendicular to the surface of the water for a portion and curves inwardly toward the opening 46. The front leading surface 38 levels the height of the surface waves of the body of water so a substantially laminar flow of the floating material 12 enters the scoop 34 through the opening 46. The scoop 34 is adjustable as to its height relative to the surface 10 by hydraulic means not shown so that the system has a range of adjustability from calm bodies of water to surfaces having high turbulent waves.

The lower tail portion 40 is adjustable not only to control the substantially laminar flow of the material 12 entering the opening 46 but also may be lowered or raised as needed to scoop the appropriate depth of the material floating on the surface. The depth of floating material can range from a thin surface film to a layer several inches deep, depending on the type and viscosity of the material, the amount spilled, weather and current conditions, etc.

The substantially laminar flow of the material entering the scoop enables the floating material to be more efficiently separated from the surface of the water. As the material flows into the scoop, a mechanical apparatus of a type discussed fully below, separates the material from the surface and deposits it into a trough formed in the scoop housing where it can then be pumped back to the collection tanks 26 and 28.

Figure 4:
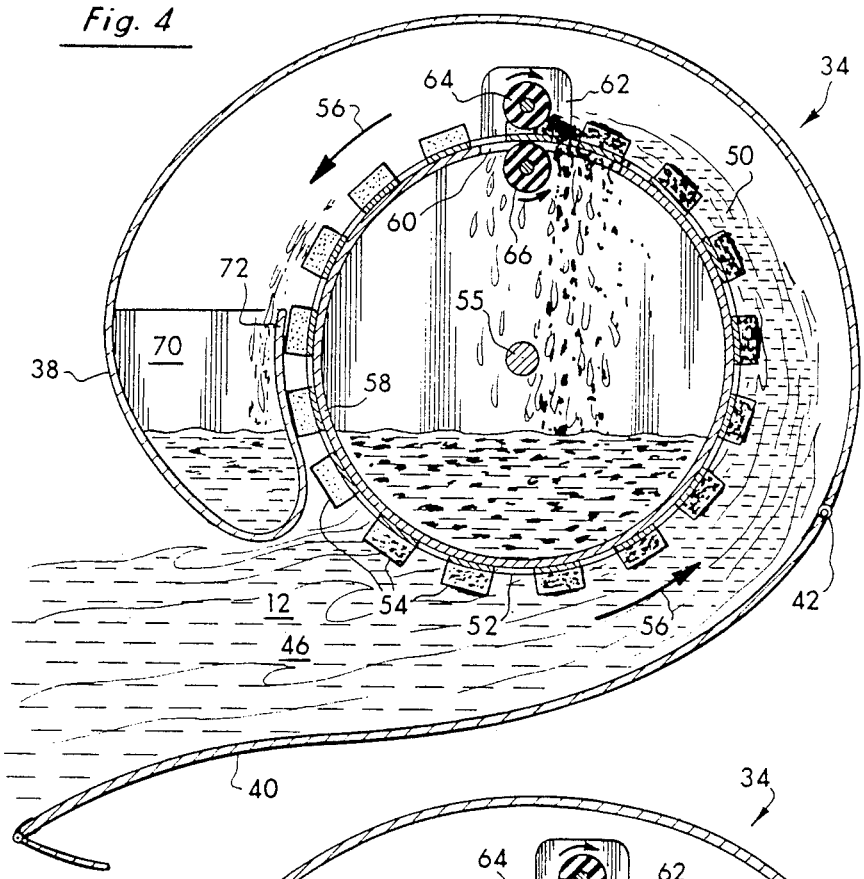
FIG. 4 is a cross-section view of the preferred embodiment of the scoop.

The mechanical separating apparatus 50 of the preferred embodiment is illustrated in FIG. 4. The separating apparatus includes an elongated frame 52 formed of screen mesh rotatably mounted within the housing 36 of the scoop. The frame 52 could also be formed of a framework having elongated spaces instead of the screen mesh. The frame 52 is shown as an elongated cylinder as the preferred embodiment for illustrative purposes and is not meant to exclude other variations. The separating apparatus can also utilize a wire frame in lieu of the frame 52 in any of the embodiments discussed below. The wire frame rotates about guides formed in the ends of the housing. Any of the frames can rotate in a cylindrical fashion, or in a square shape, or in other geometrical patterns. For illustrative purposes only, the frame will be discussed without specific mention of the alternative approach using the wire frame.

The frame 52 is rotated by well-known drive means not shown, such as a drive shaft, hydraulic motors, belt and pulley or chain and sprocket powered by the engine structure 24. A plurality of elongated compressible absorbent pads 54 are mounted on the periphery of the frame 52. The pads 54 are spaced from and parallel to one another along the periphery of the frame 52 and parallel to the axis of rotation 55 of the separating apparatus. As the frame 52 is rotated in the direction of arrow 56, the pads 54 are rotated through the floating material 12 which has entered through opening 46 of the scoop housing 36. The lighter density of the floating material 12 enables the pads 54 to push the material 12 up onto the frame 52 and carry it upwards as the frame 52 rotates. The material 12 will typically adhere to and be absorbed or be scooped by the pads 54 as the pads rotate through the floating material.

The separating apparatus 50 of the preferred embodiment has two trough areas to deposit the floating material once it has been separated from the surface 10 of the body of water. The first trough is a stationary cylindrical trough 58 located internal to the rotating frame 52. The stationary trough 58 has an opening 60 located near the top of the frame 52.

A removal apparatus 62 is mounted adjacent the stationary trough opening 60 to remove the separated material 12 from the pads 54 and the frame 52. In the preferred embodiment the removal apparatus 62 uses two elongated rollers 64 and 66 mounted on the trough 58 or on the housing 36, parallel to the frame axis of rotation. Roller 64 is mounted above and adjacent to the periphery of the frame 52 and roller 66 is mounted below and adjacent to the periphery of the frame 52. The rollers are mounted to freely rotate. The rollers could also be rotatably driven by the rotation of the frame 52 or can rotatably drive the frame 52. As the periphery of the frame 52 rotates through the two rollers, the pads 54 are compressed to squeeze the separated material 12 from the pads 54 and through the screen mesh of the frame 52 into the opening 60 of the stationary trough 58. The material 12 which has collected on the frame 52 is also squeezed through the screen mesh or from the frame 52 into the opening 60 of the stationary trough 58. The material 12 which collects there is then pumped back to the tanks 26 and 28.

A second collection trough 70 is formed in a side portion of the housing 36. The trough 70 is formed by the internal wall of the leading surface 38 of the housing. Any material 12 left on the frame 52 and pads 54 is deposited in the side trough 70 by the centrifugal action of the rotation of the frame 52. Alternatively, the removal apparatus 62 can be mounted adjacent to the side trough 70 to be used without the stationary trough 58.

Figure 5:
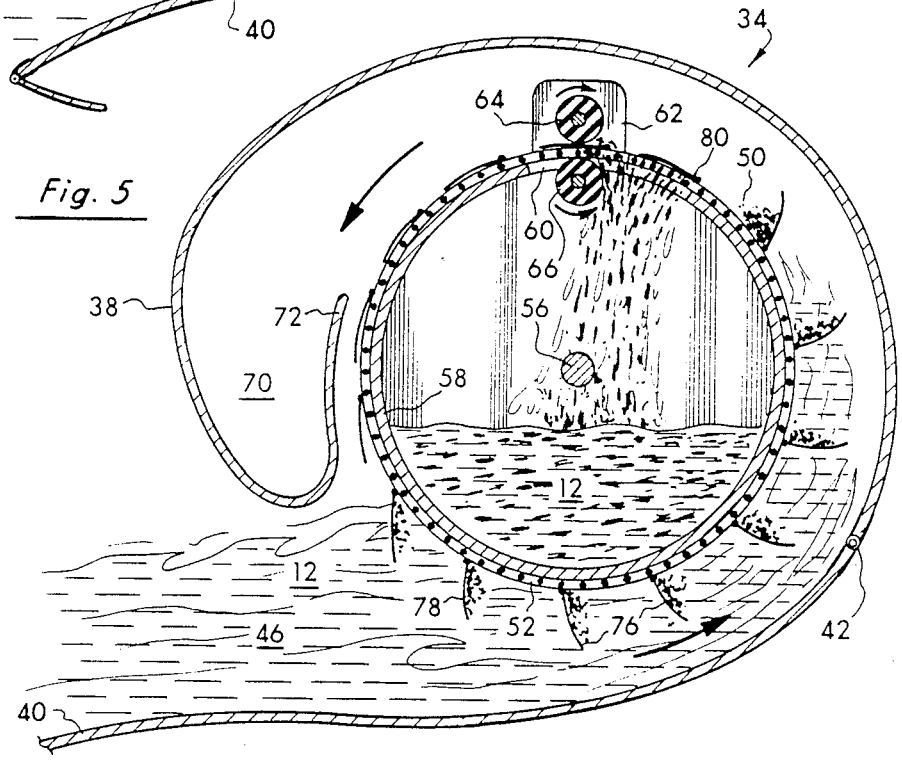
FIG. 5 is a cross-section view of a second embodiment of the scoop.

Another embodiment of the separating apparatus 50 is illustrated in FIG. 5. The details of the rotating frame 52 or the wire frame, the stationary trough 58, the removal device 62 and the side trough 70 are the same. Elongated paddles 76 are used in lieu of the compressible pads 54. The paddles 76 are mounted parallel to and spaced from one another on the periphery of the frame 52. The paddles 76 are able to pivot ninety degrees from a first position 78 extending perpendicular to the frame 52 to a second position 80 lying flat on the periphery of the frame. The paddles 76 are prevented from rotating backwards beyond the perpendicular position 80 by stop means not shown.

As the frame 52 rotates through the material 12 which has entered the scoop through the opening 46, the paddles 76 extend substantially perpendicular to the frame periphery to scoop the material 12 floating on the surface 10. As the paddles 76 approach the opening 60 of the stationary trough 58 and the removal device 62, the paddles 76 are pivoted toward the position 80 either by passive means of the geometry of the apparatus or by active means on the housing track not shown, thereby depositing the material 12 into the stationary trough 58.

The rotation of the frame 52 through the rollers 64 and 66 squeezes the material 12 through the frame 52 and into the trough 58. The use of the removal apparatus can be eliminated by changing rotation of the frame 52 and reversing the paddle design and action to deposit the material 12 into the side trough 70.

Figure 6:
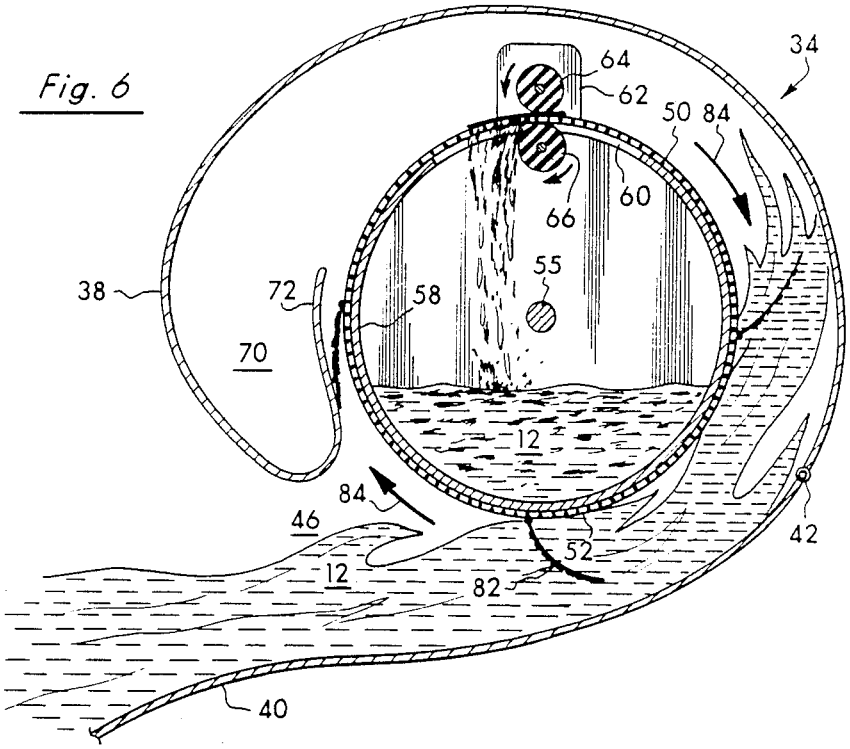
FIG. 6 is a cross-section view of a third embodiment of the scoop.

A third embodiment of the separating apparatus 50 of the present invention is illustrated in FIG. 6. The details of the frame 52 or the wire frame, the stationary trough 58, the removal apparatus 62 and the side trough 70 are similar to the above embodiments. In this embodiment, elongated flaps 82 are mounted securely to the periphery of the frame 52 to be spaced from and parallel to one another and parallel to the axis of rotation 55 of the frame. The frame 52 in this embodiment rotates as indicated by arrows 84 in the direction against the incoming flow of material 12 through the opening 46 of the housing 36. The flaps 82 extend through the floating material 12 on the surface 10 to absorb and scoop the material 12 as the flaps are rotated through the material. As the flaps 82 rotate upwards, the flaps are bent backwards by the edge 72 of the side trough 70. The material 12 is deposited over the edge 72 into the side trough 70 by the centrifugal action of the rotation of the frame 52. The remaining material 12 is squeezed through the screen mesh or the frame work of the frame 52 as the periphery of the frame is rotated through rollers 64 and 66.

Figure 7:
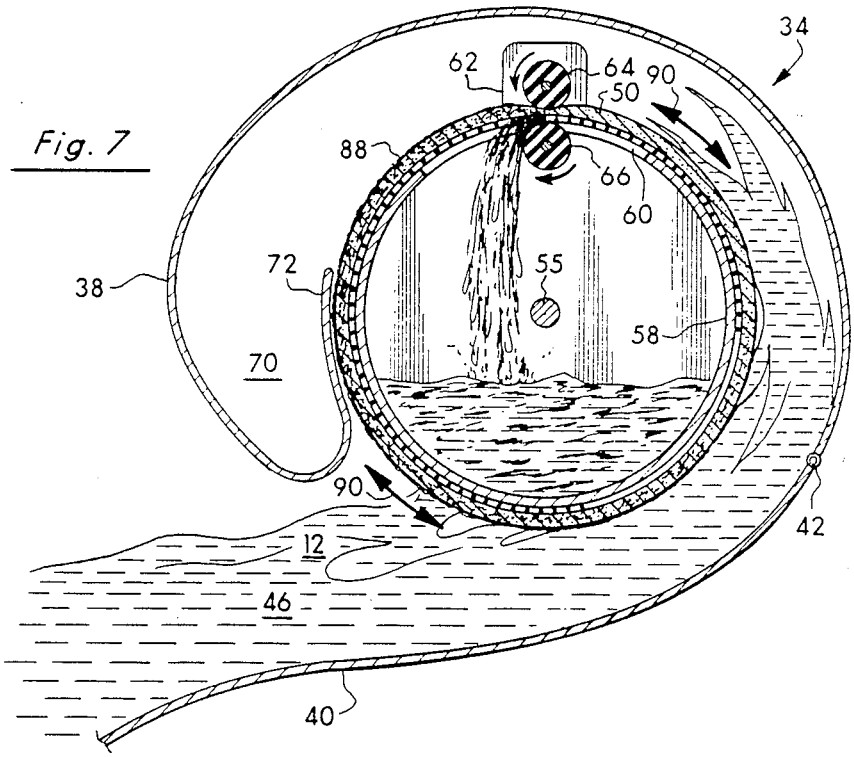
FIG. 7 is a cross-section view of a fourth embodiment of the scoop.

A fourth embodiment of the separating apparatus 50 is shown in FIG. 7. Again, the details of the frame 52, the stationary trough 58, the removal apparatus 62 and the side trough 70 are similar to the above embodiments. The frame 52 is covered with either a single layer of permeable material 88 or with multiple layers of permeable material as best suited by the type of material 12 to be recovered. The frame is rotated in either direction as indicated by arrows 90. The floating material 12 adheres to the permeable layer 88 as the periphery of the frame 52 rotates through the incoming flow. As the periphery of the frame rotates through the rollers 64 and 66, the collected material 12 is squeezed through the layer or layers 88 into the trough 58. If multiple layers are utilized, the layers are overlapped so the material may communicate between the layers. The material 12 will be collected by the outer layer and then be moved through successive layers by the action of the rotation of the frames. As the layers rotate through the rollers 64 and 66, the material is squeezed through and out of the inner layer into the trough 58.

Figure 8:
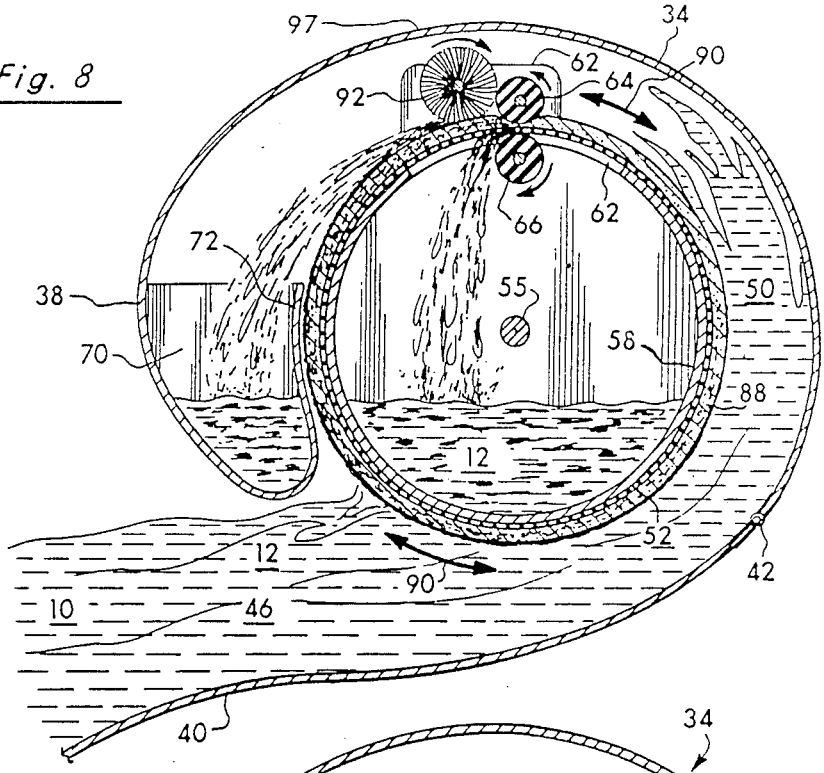
FIG. 8 is a cross-section view of a power broom mounted on the scoop of FIG. 7.

An additional removal device may also be utilized to further clean the separating apparatus 50. As illustrated in FIG. 8, a power broom 92 may be mounted adjacent the periphery of the frame 52 either near the rollers 64 and 66 as shown or adjacent the side trough 70. The power broom 92 brushes the material 12 from the periphery of the frame and from the layer 88 into the side trough 70. The power broom could also be used in any of the other embodiments discussed above. The power broom 92 is effective in situations when the floating material 12 includes chunks of hard floatage which need to be broken down in order to be of a size easily pumped. The power broom 92 may also be mounted near the surface to assist in the separation of the material 12 from the surface 10 of the body of water. Multiple power brooms mounted about the housing can also be used if needed.

Figure 9:
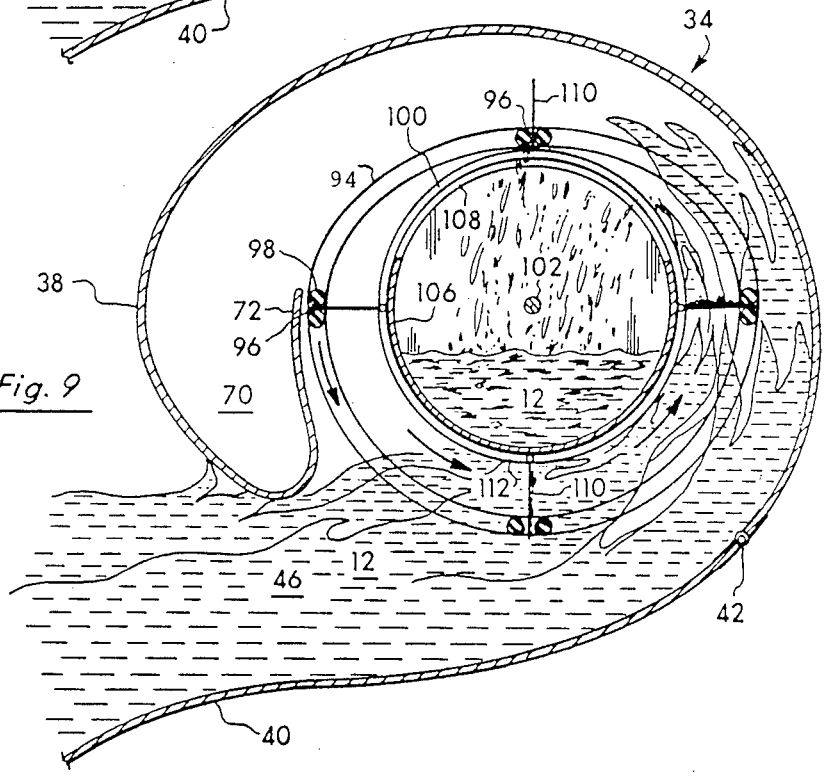
FIG. 9 is a cross-section view of a fifth embodiment of the scoop.

A fifth embodiment of the separating apparatus is illustrated in FIG. 9. In this embodiment, the separating apparatus 50 includes an elongated frame 112 rotating about an axis of rotation 102. The frame 112 can be an elongated frame having a screen mesh or framework or a wire frame or other suitable forms. Semi-rigid paddles 110 are mounted on the periphery of the frame 112 extending perpendicular thereto. A stationary trough 106 is mounted within the frame 112 and has an opening 108 formed in the top of the trough 106.

Grooves 94 are formed in each end of the housing. The lower portion of the grooves are formed in a substantially circular shape having a radius point at the axis of rotation 102. The upper portion of the grooves 94 are formed in a substantially elliptical shape so that the topmost point of the grooves 94 are tangential to the topmost point of the frame 112.

Elongated rollers 96 and 98 are mounted in the housing to freely rotate in the housing following the path of the grooves 94. The rollers are mounted in pairs so the rollers 96 are mounted on the forward side of the paddles 110 and rollers 98 are mounted on the rearward side of the paddles 110.

The separating apparatus of this embodiment is designed so as paddles 110 rotate through the floating material 12, rollers 96 and 98 extend to the outermost edge of the paddles 110 to scoop up and absorb the material. When the paddles are at some point between the lowermost point and uppermost point, the rollers move into the elliptical portion of the grooves 94. As the rollers follow the elliptical portion, they began to move downward relative to the paddles 110, thus forcing the material 12 downward off of the paddle and into the opening 108 of the trough 106. As the paddles 110 reach the uppermost point, the rollers 96 and 98 are against the periphery of the frame 112 and have squeezed the material into the trough 106. The rollers then begin to move back to the tip of the paddles as they continue to follow the grooves 94. A power broom could also be utilized to further clean the paddles 110.

The present invention is not meant to be limited to the above description of illustrative embodiments but encompasses the full range of the inventive scope. For instance, a conveyor belt could be used in lieu of the frame arrangement with scoops, permeable layers, and the like. Also the eccentric motion of the frames in the last embodiment could be reversed so that the paddles extend outward of the rollers as the frames rotate through the floating material.

The system of the present invention is designed to be adaptable to the conditions present at the site to be cleaned. Each of the separating apparatus embodiments is designed to be quickly interchangeable with a single scoop depending on the current need. For instance, the use of the compressible pads is recommended for materials which are light and are present in a thin film. The paddles are used where the floating material is deeper beneath the surface. The permeable layer is used with floating material that is sticky. The use of the eccentric frames may be necessary where there is a heavy material and at a greater depth. Most of the frames can be used effectively with any combination of material 12.

As discussed above, the system of the current invention represents an important and viable method of protecting the environment from catastrophic damage due to contamination from floating materials resulting from spillage or other incidents. The system can be quickly transported to virtually any region in the world and used in almost any site condition. The spiral shape of the scoop with the articulated lower tail portion enables the turbulence of the surface to be leveled into a smooth laminar flow entering the scoop. The laminar flow of the floating material enables a more efficient separating process resulting in a faster recovery not only of the floating material but also for the ecology of the surrounding environment. The modular design of the system allows a variety of interchangeable separating mechanisms so the mechanism best suited to the particular site condition can be selected.

The above description of the preferred embodiments are for illustrative purposes and are not meant to specifically limit the scope of the claimed invention. Other modifications and variations are considered to be within the range and scope of the invention.

I claim:

1. An apparatus for recovering floating material from the surface of a body of water, said apparatus comprising a housing; said housing comprising an elongated scoop with a substantially spiral shaped cross-section;

said scoop having a front leading edge surface and a lower tail section to form an opening for said floating material to enter said housing in a substantially laminar flow;

an elongated frame having an outer periphery, said frame mounted rotatably on said housing so the lower section of the periphery of said frame rotates through said floating material;

means mounted on the periphery of said frame to separate said material from said surface;

means mounted on said apparatus adjacent said periphery of said frame to remove said material from said separating means; and means in said housing to retain said removed material.

2. The apparatus of claim 1 wherein said separating means comprise a plurality of absorbent compressible pads mounted on the periphery of said frame spaced from and parallel to one another and parallel to the axis of rotation of said frame so said material adheres to said pads as said pads rotate through said material.

3. The apparatus of claim 2 wherein said removal means comprise a rotating broom mounted adjacent to the periphery of said frame and adjacent said retaining means.

4. The apparatus of claim 2 wherein said removal means comprise roller means mounted adjacent to said retaining means and adjacent to the periphery of said frame to compress said pads as said frame rotates by said roller means to remove said material from said pads and deposit said removed material into said retaining means.

5. The apparatus of claim 4 wherein said retaining means comprise a first trough mounted within said frame;

said first trough having an opening adjacent said roller means.

6. The apparatus of claim 4 wherein said removal means further comprise a rotating broom mounted adjacent to the periphery of said frame and adjacent said retaining means.

7. The apparatus of claim 2 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail section.

8. The apparatus of claim 7 wherein said scoop further comprises means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

9. The apparatus of claim 2 wherein said retaining means comprise a first trough formed internal to said rotating frame and a second trough formed by the internal wall of said front leading surface; and said apparatus comprises means to pump said collected material from said retaining means to a remote retaining means.

10. The apparatus of claim 2 wherein said frame comprises a cylinder.

11. The apparatus of claim 1 wherein said separating means comprise a plurality of elongated paddles mounted parallel to and spaced from each other and parallel to the longitudinal axis of said frame;

said paddles mounted to pivot between a first position extending perpendicular to the periphery of said frame and a second position lying flat on said frame whereby said paddles extend perpendicular to the periphery of said frame as said frame rotates through said material to separate said material from said surface and said paddles lie flat on said frame as said frame rotates adjacent said retaining means to remove said material from said paddles.

12. The apparatus of claim 11 wherein said retaining means comprise a stationary trough mounted within said rotating frame with an open top to collect said material as said frame rotates near said open top.

13. The apparatus of claim 12 wherein said removal means comprise roller means mounted on said apparatus adjacent to said periphery and adjacent to said retaining means to squeeze said material from said paddles as said paddles rotate through said roller means.

14. The apparatus of claim 13 wherein said removal means further comprise a rotating broom mounted adjacent to the periphery of said frame and adjacent said retaining means.

15. The apparatus of claim 11 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

16. The apparatus of claim 15 wherein said scoop further comprises means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

17. The apparatus of claim 11 wherein said retaining means comprise a side trough portion formed from the internal wall of said front leading edge surface; and said apparatus comprises means to pump said collected material from said retaining means to a remote retaining means.

18. The apparatus of claim 17 wherein said retaining means further comprises a stationary trough mounted within said rotating frame with an open top to collect said material as said frame rotates near said open top.

19. The apparatus of claim 11 wherein said removal means comprise a rotating broom mounted adjacent to the periphery of said frame and adjacent said retaining means.

20. The apparatus of claim 11 wherein said frame comprises an elongated cylinder.

21. The apparatus of claim 1 wherein said separating means comprise a plurality of flexible paddles mounted parallel to and spaced from one another and parallel to the longitudinal axis of said frame.

22. The apparatus of claim 21 wherein said removal means comprise means on said housing adjacent to said retaining means and adjacent to said periphery of said frame to remove said material from said paddles.

23. The apparatus of claim 22 wherein said removal means further comprise roller means mounted on said housing to squeeze said material from said paddles and said frame as said periphery rotates through said roller means.

24. The apparatus of claim 23 wherein said removal means further comprise a rotating broom mounted adjacent to the periphery of said frame and adjacent said retaining means.

25. The apparatus of claim 22 wherein said removal means comprise a rotating broom mounted adjacent to the periphery of said frame and adjacent said retaining means.

26. The apparatus of claim 21 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

27. The apparatus of claim 26 wherein said scoop further comprise means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

28. The apparatus of claim 21 wherein said retaining means comprise a stationary trough formed internal to said rotating frame and a side trough portion formed from said internal wall of said front leading surface; and said apparatus comprises means to pump said collected material from said retaining means to a remote retaining means.

29. The apparatus of claim 21 wherein said frame comprises an elongated cylinder.

30. The apparatus of claim 1 wherein said separating means comprise a permeable material mounted on the periphery of said frame; said permeable material having the property of absorbing said floating material from said surface and said floating material adhering to said permeable material as said permeable material rotates through said floating material.

31. The apparatus of claim 30 wherein said removal means comprise roller means mounted adjacent to said periphery of said frame and adjacent to said retaining means to squeeze said floating material from said permeable material as said periphery rotates through said roller means.

32. The apparatus of claim 31 wherein said retaining means comprise a stationary trough mounted within said rotating frame having an open top adjacent said removal means.

33. The apparatus of claim 31 wherein said removal means further comprise a rotating broom mounted adjacent to the periphery of said frame and adjacent said retaining means.

34. The apparatus of claim 30 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

35. The apparatus of claim 34 wherein said scoop further comprises means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

36. The apparatus of claim 35 wherein said retaining means comprise a first trough formed internal to said rotating frame and a second side trough portion formed from the internal wall of said front leading surface; and said apparatus comprises means to pump said collected material from said retaining means to a remote retaining means.

37. The apparatus of claim 30 wherein said removal means comprise a rotating broom mounted adjacent to the periphery of said frame and adjacent said retaining means.

38. The apparatus of claim 30 wherein said frame comprises an elongated cylinder.

39. The apparatus of claim 1 wherein said apparatus further comprises a plurality of elongated paddles mounted on the periphery of said frame and extending perpendicularly therefrom;

cam grooves formed on each end of said housing;

a plurality of elongated rollers mounted to follow in said grooves;

said grooves formed in such a manner that each of said paddles have a roller on each side of each of said paddles and said rollers extend to the tip of said paddles as said paddles rotate through said material and said rollers are near said frame as said paddles are adjacent said retaining means.

40. The apparatus of claim 39 wherein said retaining means comprise a first trough mounted within said frame with an open top.

41. The apparatus of claim 39 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

42. The apparatus of claim 41 wherein said scoop further comprises means to a said lower tail portion with respect to said front leading surface to adjust the size of said entry opening and to adjust the depth of said lower tail portion beneath said surface to maintain said laminar flow; and means to pivotally adjust said wing tail portion relative to said lower tail portion to provide said hydrodynamic control.

43. The apparatus of claim 39 wherein said retaining means comprise a first formed internal to said rotating frame and a second side trough portion formed from the internal wall of said leading surface; and said apparatus comprises means to pump said collected material from said retaining means to a remote retaining means.

44. The apparatus of claim 39 wherein said removal means comprise a rotating broom mounted adjacent to the periphery of said frame and adjacent said retaining means.

45. The apparatus of claim 1 wherein said retaining means comprise a first trough mounted within said frame;

said first trough having an opening adjacent said removing means.

46. The apparatus of claim 1 wherein said removal means further comprise a rotating broom mounted adjacent to the periphery of said frame and adjacent said retaining means.

47. The apparatus of claim 1 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail section.

48. The apparatus of claim 47 wherein said scoop further comprises means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

49. The apparatus of claim 1 wherein said retaining means comprise a first trough formed internal to said rotating frame and a second trough formed by the internal wall of said front leading surface; and said apparatus comprises means to pump said collected material from said retaining means to a remote retaining means.

50. The apparatus of claim 1 wherein said frame comprises a cylinder.

51. An apparatus for recovering floating material from the surface of a body of water, said apparatus including a scoop having an elongated housing with a substantially spiral-shaped cross-section;

said housing includes a lower tail portion cooperating with a front leading surface on said housing to form an opening along the elongated front side of said housing to receive said material floating on said surface in a substantially laminar flow by reducing the wave action of said surface;

means in said scoop for separating said material from said surface;

means in said scoop for collecting said separated material; and said scoop further comprises an elongated side trough portion formed in said housing by the internal wall of said front leading surface to retain said collected material.

52. The apparatus of claim 51 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

53. The apparatus of claim 52 wherein said scoop further comprises means to adjust said lower tail portion with respect to said front leading surface to adjust the size of said entry opening and to adjust the depth of said lower tail portion beneath said surface to maintain said laminar flow of said material into said opening; and means to pivotally adjust said wing tail portion relative to said lower tail portion to provide said hydrodynamic control.

54. The apparatus of claim 51 wherein said apparatus is mounted on a floating vessel.

55. The apparatus of claim 51 wherein said means to separate said material from said surface comprises an elongated rotatable frame mounted within said housing; said frame includes means mounted on the periphery of said frame to pick up said material from said surface.

56. The apparatus of claim 55 wherein said collecting means comprise means to remove said material from said periphery of said frame and deposit said material in said side trough.

57. The apparatus of claim 56 wherein said scoop further comprises a second trough mounted within said rotating frame to retain said collected material.

58. The apparatus of claim 57 further including a remote retaining area separate from said scoop and means to pump said material retained in said side trough and said frame trough to said remote retaining area.

59. The apparatus of claim 51 further including a remote retaining area separate from said scoop and means to pump said material retained in said side trough to said remote retaining area.

60. An apparatus for recovering floating material from the surface of a body of water, said apparatus including a scoop having an elongated housing with a substantially spiral-shaped cross-section;

said housing includes a lower tail portion cooperating with a front leading surface on said housing to form an opening along the elongated front side of said housing to receive said material floating on said surface in a substantially laminar flow by reducing the wave action of said surface;

a narrow wing tail portion pivotally mounted to the tip of said lower tail portion along the length of said housing and extending downwardly and rearwardly of said tip to provide hydrodynamic control of said lower tail section from the action of the water flowing against said lower tail portion;

said scoop further comprises means to adjust said lower tail portion with respect to said front leading surface to adjust the size of said entry opening and to adjust the depth of said lower tail portion beneath said surface to maintain said laminar flow of said material into said opening;

means to pivotally adjust said wing tail portion relative to said lower tail portion to provide said hydrodynamic control;

said scoop further comprises an elongated side trough portion formed in said housing by the internal wall of said front leading surface to retain said collected material;

an elongated frame rotatably mounted within said housing with means mounted on the periphery of said frame to separate said material from said surface;

a second trough mounted within said rotating frame;

roller means mounted adjacent to said periphery and adjacent to said second trough to remove said material from said separating means; and means to pump said material from said side trough and said second trough to a remote retaining area.

61. An apparatus for recovering floating material from the surface of a body of water, said apparatus comprising a housing;

an elongated frame having an outer periphery, said frame mounted rotatably on said housing so the lower section of the periphery of said frame rotates through said floating material;

a plurality of elongated paddles mounted on the periphery of said frame and extending perpendicularly therefrom;

cam grooves formed on each end of said housing;

a plurality of elongated rollers mounted to follow in said grooves;

said grooves formed in such a manner that each of said paddles have a roller on each side of each of said paddles and said rollers extend to the tip of said paddles as said paddles rotate through said material and said rollers are near said frame as said paddles are adjacent said retaining means;

means mounted on said apparatus adjacent said periphery of said frame to remove said material from said paddles; and means in said housing to retain said removed material.

62. The apparatus of claim 61 wherein said retaining means comprise a first trough mounted within said frame with an open top.

63. The apparatus of claim 61 wherein said housing comprises an elongated scoop with a substantially spiral shaped cross-section;

said scoop having a front leading edge surface and a lower tail section to form an opening for said floating material to enter said housing in a substantially laminar flow.

64. The apparatus of claim 63 wherein said scoop further comprises a narrow wing tail portion pivotally mounted to the tip of said lower tail portion along the length of said scoop and extending downwardly and rearwardly of said tip to provide hydrodynamic control of said lower tail section from the action of the water flowing against said lower tail portion.

65. The apparatus of claim 64 wherein said scoop further comprises means to adjust said lower tail portion with respect to said front leading surface to adjust the size of said entry opening and to adjust the depth of said lower tail portion beneath said surface to maintain said laminar flow; and means to pivotally adjust said wing tail portion relative to said lower tail portion to provide said hydrodynamic control.

66. The apparatus of claim 65 wherein said retaining means comprise a first trough formed internal to said rotating frame and a second side trough portion formed from the internal wall of said leading surface; and said apparatus comprises means to pump said collected material from said retaining means to a remote retaining means.

67. The apparatus of claim 61 wherein said removal means comprise a rotating broom mounted adjacent to the periphery of said frame and adjacent said retaining means.

* * * * *